United States Patent [19]

Bowman

[11] Patent Number: 5,039,248

[45] **Date of Patent: * Aug. 13, 1991**

[54] SUPPORT FOR CATCH BASIN COVER

[76] Inventor: Harold M. Bowman, 18867 N. Valley Dr., Fairview Park, Ohio 44126

[ * ] Notice: The portion of the term of this patent subsequent to Sep. 19, 2006 has been disclaimed.

[21] Appl. No.: 560,184

[22] Filed: Jul. 31, 1990

Related U.S. Application Data

[63] Continuation-in-part of Ser. No. 366,177, Jun. 13, 1989, Pat. No. 4,969,771, and a continuation-in-part of Ser. No. 362,216, Jun. 6, 1989, Pat. No. 4,966,489, and a continuation-in-part of Ser. No. 362,257, Jun. 6, 1989, Pat. No. 4,963,053.

[51] Int. Cl.[5] ..... E02D 29/14

[52] U.S. Cl. ..... 404/26; 404/25

[58] Field of Search ..... 404/26, 25; 52/20

[56] References Cited

U.S. PATENT DOCUMENTS

| | | | |
|---|---|---|---|
| 4,544,302 | 10/1985 | Farrelly . | |
| 4,867,600 | 9/1989 | Bowman | 404/26 |
| 4,963,053 | 10/1990 | Bowman | 404/26 |
| 4,966,489 | 10/1990 | Bowman | 404/26 |

*Primary Examiner*—Ramon S. Britts
*Assistant Examiner*—Nancy Connolly
*Attorney, Agent, or Firm*—Watts, Hoffmann, Fisher & Heinke Co.

[57] ABSTRACT

A peripherally adjustable insert is shown for raising the grade of a generally rectangular grating that previously was supported by the end sills of the frame and by the roadway-side longitudinal sill if the frame has one. The insert comprises a base having support elements, the base being adjustable in length and adapted to rest on said sills, and ledge and keeper elements supported by the base to seat the grating restrict its lateral movement. The support elements of the base comprise a pair of essentially parallel end elements and a pair of essentially parallel side elements, and the support elements being equipped with terminals that are joined to form these base elements generally into a rectangle. The rectangle includes spreader means such as turnbuckle bolts that form matched adjustable junctions between each terminal of at least one end support element and a terminal of each side support element for rendering said at least one end support element movable in the plane of the longer axis of the rectangular base.

28 Claims, 3 Drawing Sheets

SUPPORT FOR CATCH BASIN COVER

This application is a continuation-in-part of the following applications Ser. Nos.: 07/366,177 of June 13, 1989, entitled "Manhole Cover Support Having Enhanced Grip", now U.S. Pat. No. 4,969,771; 07/362,216 of June 6, 1989, entitled "Manhole Cover Support With Interbraced Top Members"; now U.S. Pat. Nos. 4,966,489; and 07/362,257 of June 6, 1989, entitled "Multicomponent Bases and Wales for Manhole Cover Supports", now U.S. Pat. No. 4,963,053. The teachings of these applications are incorporated herein by reference. This application also is related to U.S. Pat. Nos. 4,834,574, 4,867,600, 4,867,601 and 4,872,780.

BACKGROUND OF THE INVENTION

This invention relates to an adjustable-in-length insert for raising the grade of a generally rectangular grating that resides in a catch basin frame or in a similar manhole frame or utility access hole. It usually is installed preparatory to repaving or resurfacing the pavement around the top of the frame. The term "catch basin frame" will be used for simplicity herein to mean any utility access hole frame fitted with a removable grating.

Unique problems are involved in such installation. In the typical frame the grating rests on and is supported mainly by the end sills of the frame, and, if the frame also has a roadway-side (as distinguished from the curb side or pavement edge side) longitudinal sill, then by such longitudinal sill also. Ordinarily there is little if any support for the grating along the curb side of the frame, and often the only support for it is at each end of the frame. Thus, when the grating is removed and the adjustable raising insert is fitted tightly in the frame, there is at least one and sometimes there are two long gaps under the sides of the insert where the insert lacks support.

To extend or foreshorten the sides of the inserts conventionally from their middles or ends (e.g. with slip-joints or screw-operated extender joints) puts undesirable strain on such end or side joints and incurs attendant risk.

Such inserts and their joints often must stand up to heavy axle loads and impact loads from vehicles and snow plows without a hazardous failure. Even if the rest of the side of an insert is heavy and strong, the length-adjusting joints of the insert can be very vulnerable to malfunction or, worse, to failure.

Another problem is the fitting of the insert to a catch basin frame that has a curb box, and many of them do. This adds vertical impedance features which must be accommodated.

Additionally, as there are often only the collar elements rising from the two end sills of the frame to react against most if not all of the insert-tightening pressure, it is especially desirable to exert a great deal of force against these elements. This is to get thereby as much frictional grip on the insert as possible; this supplements the mechanical hooks, clamps and like hold-down means that attach the insert to the in-place catch basin structure or manhole structure below.

The instant insert overcomes the lack of curb side support, and it need not be unusually heavy to do so; it also can be made to accommodate a curb box handily; and it is capable of being fitted very tightly between and against the collar elements on the end sills of the catch basin frame.

BROAD STATEMENT OF THE INVENTION

The instant adjustable insert is for raising the grade of a generally rectangular grating that previously was supported in a catch basin frame, the grating originally having been disposed to rest on the end sills of said frame, (and further to rest on the roadway-side longitudinal sill of said frame if it has said longitudinal sill) the grating also having been disposed to be at least in part restrained laterally in the frame by collar elements arising from said sills. The insert comprises a base, ledge elements supported thereby, which ledge elements form a seat for the grating, and keeper elements attached to and rising above the ledge elements for restricting lateral movement of the grating. The base is adjustable in length and is adapted to rest on the sills of the frame; the base comprises a pair of end support elements with terminals and a pair of side support elements with terminals, said end support element terminals being joined with said side support element terminals to form generally a rectangle of the support elements, said rectangle including spreader means that form essentially matched adjustable junctions between each terminal of at least one end support element and a terminal of each side support element for rendering said at least one end support element adjustable-in-length in the plane of the longer axis of the rectangle, the terminals of both side support elements having salient load-bearing portions that extend beyond said adjustable junctions and beyond the inboard edge of the end sills of the frame for obtaining support from said end sills.

BEST MODE FOR CARRYING OUT THE INVENTION

Figure 1:
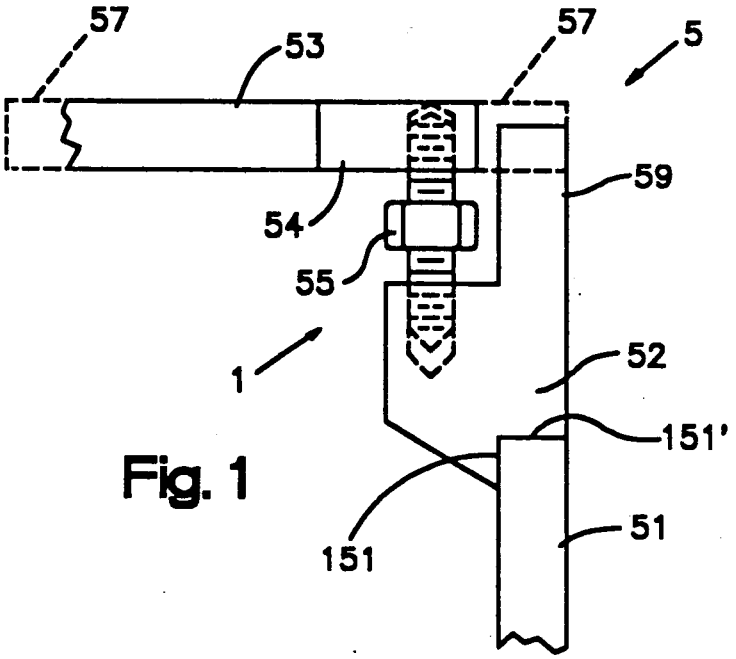
FIG. 1 is a fragmentary plan view of one type of preferred adjustable corner joint for exerting end supporting element pressure against the corresponding end collar element arising from the sill of catch basin frame. It illustrates a fundamental structural element of this invention.

Referring to FIG. 1, arrow 1 points generally to an adjustable joint for a corner of the base of the inventive insert. An end support element 53 and side support element 51 of the insert are joined by threaded stainless steel turnbuckle bolt 55 which extends into the cooperatively tapped and threaded terminals 52 and 54. Turned one way the bolt widens the joint; turned the other way, it narrows the joint.

The terminal 54 of end support element 53 rests on the end sill 57 (shown in dotted outline) of a catch-basin frame that is otherwise not illustrated. Part of the salient portion 59 of the terminal 52 of side support element 51 also rests on end sill 57. This takes the strain off the turnbuckle bolt 55. Portion 59 can be moved back and forth on sill 57, but it should not be moved off of the sill and thus lose this support.

The terminals 52 and 54 of the joined support elements are of solid cast ductile iron. These are welded at weld lines 151, 151' and 153 to hollow tubes of rectangular cross section, 13 ga. sheet steel to make the support elements 51 and 53. Portion 59 of terminal 52 is about 1" wide and 2" high, as are terminal 54 and the hollow parts of support elements 51 and 53.

All four corners of the base of the instant insert can be made generally like that of FIG. 1 to provide expansion pressure against the collar elements arising from the end sills of the catch basin frame. Actually only the two on one end need be so made, and the corners of the other end can be unadjustable, simply pivoted if desired or joined so as to constitute a rigid joint.

This is not true when the corners of the insert move in two directions as with turnbuckle bolts running slantwise to the long axes of the support elements. In such instance all four insert corners will call for oblique, adjusting elements cooperating with each other to make essentially matched adjustable junctions and thus to expand the base reasonably evenly in the best manner. By matched adjustable junctions what is meant is that any adjacent pair of the adjustable junctions can be expanded and contracted equally and essentially together. This is best done with a set of like screwoperated spreader means at each adjustable joint that can separate the joints and draw them together.

The side support elements of the base of the instant insert that lack intermediate support from long side sills of the catch basin frame, i.e. the curb side support element and sometimes both side supports, should be strong and stiff. Accordingly the longer intermediate part of such element or elements can be solid, e.g. cast ductile iron, or hollow, e.g. a steel box member, either kind often with a flat top to act as a seat member for the grating. The cross section of such box member need not be square or rectangular, but that is efficient if a box member is to be used. Often a solid side support member is preferred here for strength and resistance to the elements, salt, etc.

The terminals of the side and end support elements of the base preferably are solid for their durability and for tapping threaded holes into. Usually they are of cast ductile iron that is welded to the steel or cast ductile iron intermediate part of the side and end support elements.

Figure 2:
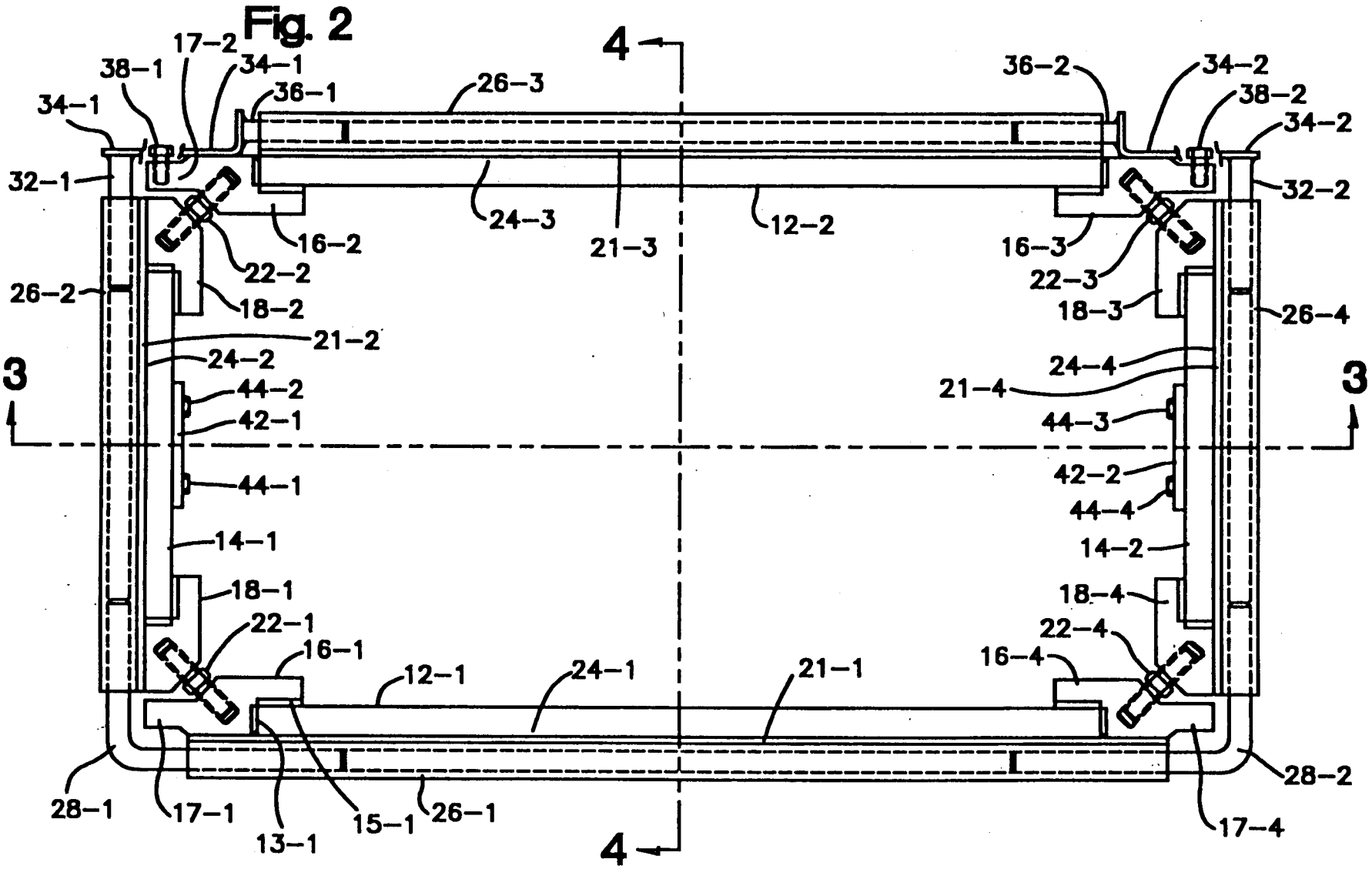
FIG. 2 is a plan view of another preferred embodiment of the invention, this one for a catch basin having a curb box and a nominally 18"×36" grating to be raised about 2 inches.

Referring to FIGS. 2–5, arrow 2 indicates generally an insert for a catch basin frame having a curb box. The upper part of FIG. 2 is the curb box side of the insert. The base of the insert has side support elements 12-1 and 12-2 with the terminals 16-1, 16-2, 16-3 and 16-4, and end support elements 14-1 and 14-2 with the terminals 18-1, 18-2, 18-3 and 18-4. The terminals and the rest of each support element are of cast ductile iron, the terminals being welded onto square cross section bar stock that is ¾" on a side. Items 13-1 and 15-1 between side support element 12-1 and terminal 18-1 are representative of the welds between each terminal and each support element all around the base of the cover support near the four corners thereof. The flat tops of the support elements constitute the ledge elements for seating the grating.

Welded to the outer wall portion of and arising from each support element of the base is a keeper element 24-1, 24-2, 24-3 and 24-4. The tops of the keeper elements are formed into square cross section (about ⅞"×⅞") hollow wales 26-1, 26-2, 26-3 and 26-4. Wale 26-3 and keeper element 24-3 are shorter in length than the others for fitting into a curb box not shown. Each keeper element 24-1, 24-2, 24-3 and 24-4 has its corresponding offset (21-1, 21-2, 21-3 and 21-4) for clearing peripheral rivet heads or other slight protrusions of the reticulum (not shown) grating (that is to be held by the inventive insert).

The roadway side corners of the keeper elements are joined by corner braces 28-1 and 28-2 which fit slidably into the wales. Curb side corners of the keeper elements are joined by the corner fittings made of end plugs 32-1 and 32-2, reach bars 34-1 and 34-2, and side plugs 36-1 and 36-2. The keeper element 24-3 is shorter in length, and it can be made even lower than the rest of the keeper elements to further accommodate the curb box. Below the reach bars 34-1 and -2 are spacer screws 38-1 and 38-2; they screw into the salient portions of terminals 16-2 and 16-3 of side support element 12-2 and react against the ends of the curb box (not shown) to help firm up the insert base from the curb side.

Figure 3:
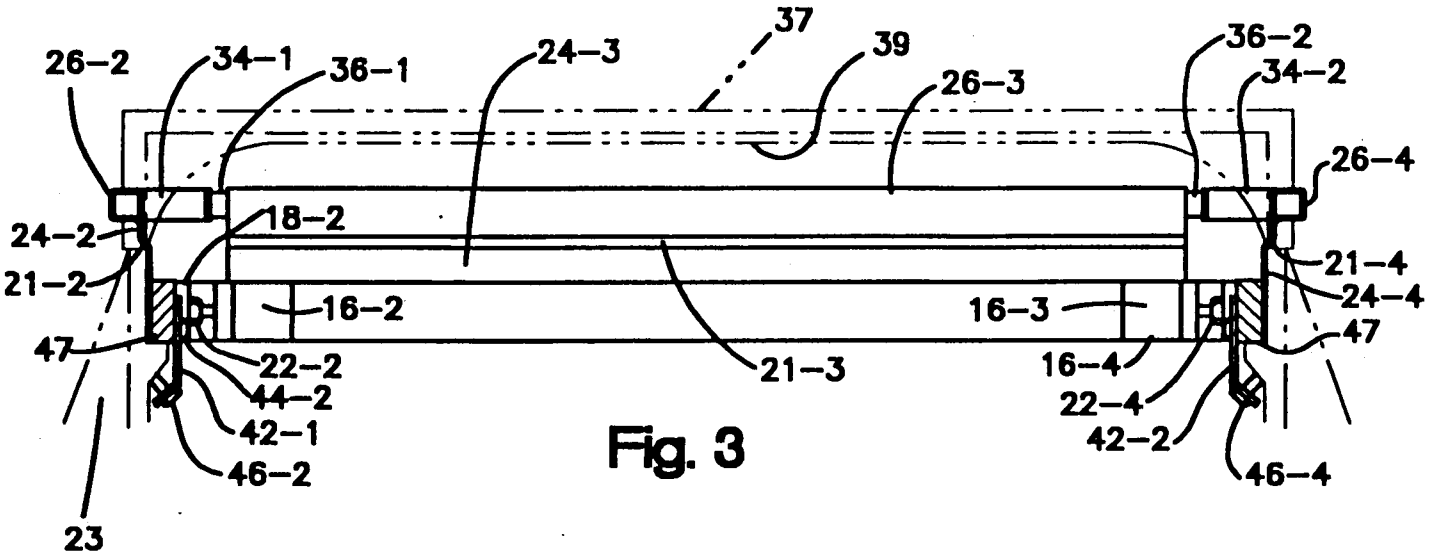
FIG. 3 is a cross sectional elevation of the insert of FIG. 2 taken through section 3—3 of FIG. 2.
Figure 4:
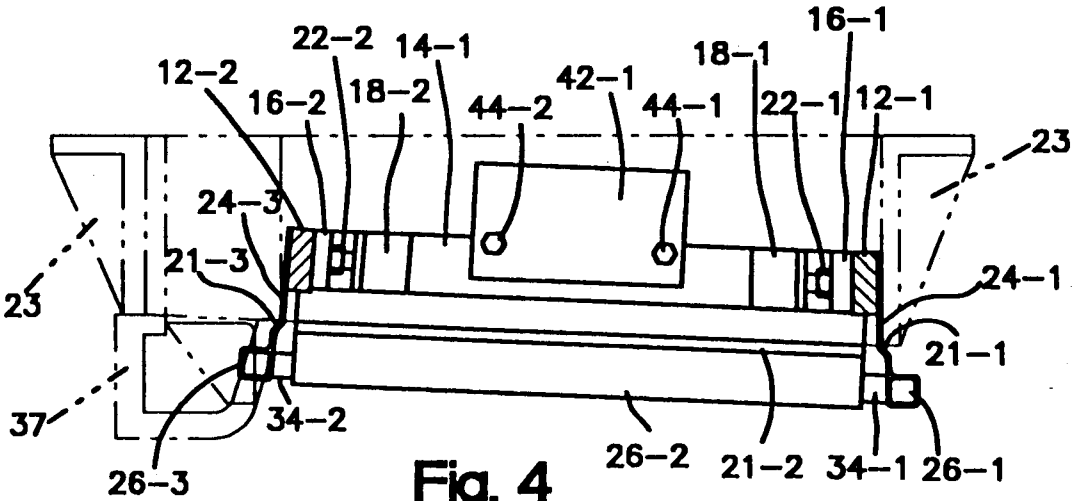
FIG. 4 is a cross sectional elevation of the insert of FIG. 2 taken through the section 4—4 of FIG. 2.

In FIGS. 3 and 4 the profiles of the catch basin frame 23 are shown in dotted outline as is curb box 37. The arcuate side drainage opening 39 of the curb box 37 is evident in FIG. 3. Frame hooks 42-1 and 42-2 are bolted to end support members 44-1, 44-2, 44-3 and 44-4. These hooks hook under the sills 46 of the catch basin frame with screws 46-2 and 46-4 and two other companion screws not shown. The slight outward offset of each rising keeper elements to clear rivet heads protruding from the periphery of a reticulum grating (not shown) can be seen in FIGS. 3 and 4.

A reticulum grating (not shown) is one made from a plurality of heavy strips on edge, usually steel. These are assembled to establish a network of essentially vertical drainage holes. This usually is done by forming some or all of the strips into bent patterns and joining them at connecting points, e.g. with rivets and/or welding. They often are used in sidewalks; heavier ones are used in roadways.

Figure 5:
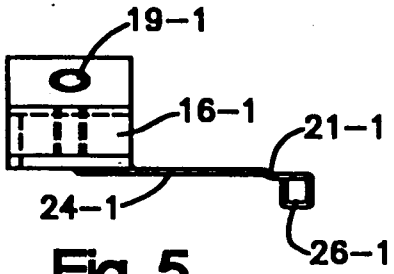
FIG. 5 is a fragmentary end elevation view of a terminal of the roadway-side support element of FIG. 2.
Figure 3:
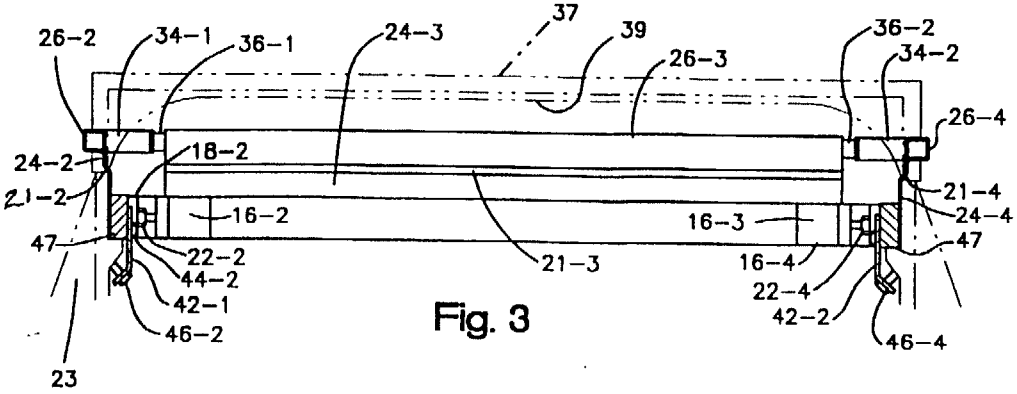
Figure 4:
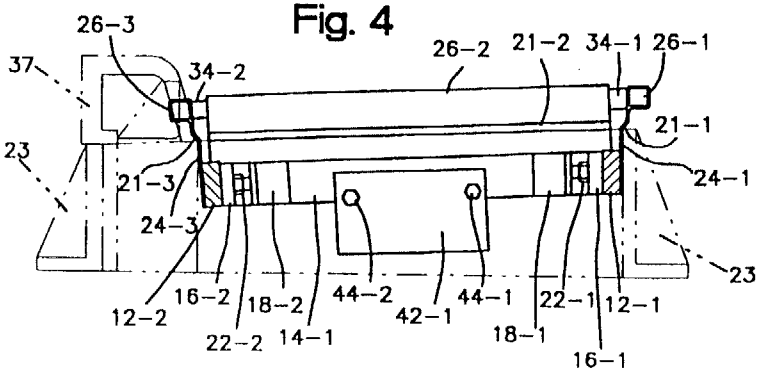
Figure 5:
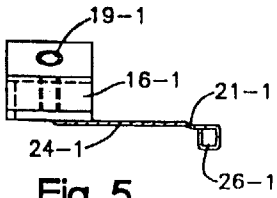

The offsets 21-1, 21-2, 21-3 and 21-4 in the rising wall of their respective keeper elements 24-1, 24-2, 24-3 and 24-4 are best seen in FIG. 5 in the end elevation view of the side support element 16-1. Therein the tapped screw hole 19-1 for one side of turnbuckle bolt 22-1 is seen as well as keeper element 24-1 with its offset 21-1 and the hollow wale 26-1.

Figure 6:
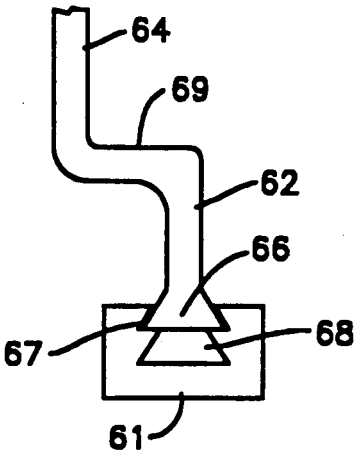
FIG. 6 is the cross sectional elevation of an all-ductile cast iron, two-piece, height-adjustable end support element with a grating seat and keeper detachable from the support.

FIG. 6 shows the cross sectional elevation of a support element 61 of an insert base that can be separated from and is supporting the ledge element 63, which is integral with keeper element 64. A grating seat element 69 is the flat top of the ledge element 63. The leg 62 extending down from the ledge element 63 has a foot 66 of trapezoidal cross section. It is fitted slidably into corresponding slot 67 of the support element 61. The foot can also be fitted into the lower like trapezoidal slot 68 of the upper element 61 to lower the seat. The elements shown in FIG. 6 are made of cast ductile iron.

Figure 7:
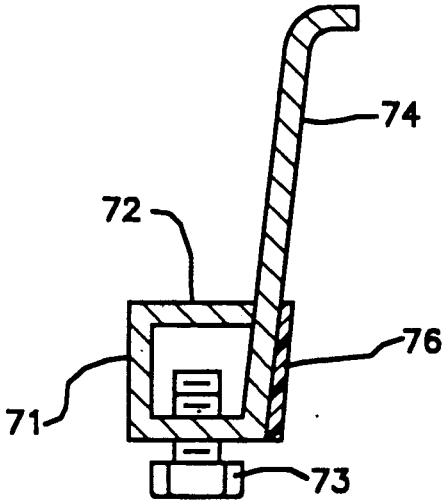
FIG. 7 is the cross sectional elevation of the all-steel core, side friction element-modified end support element unitary with the seat for the grating.

FIG. 7 shows the cross sectional elevation of an end support element 71 box member that is integral with the flanged-out keeper element 74. The ledge element 72 is the top of the box member, and it provides a seat element for the grating. Elevating screw 73 is one of eight in this particular end support element. The outside wall of this end support element 71 is coated with a tough, flat, about ⅛" thick, very slightly foamed, baked-on, somewhat elastomeric vinyl chloride plastisol coating 76 to increase the coefficient of friction between that wall and the cast iron or steel collar element of a catch basin frame (not shown). Improved frictional grip also can be had with a high coefficient-of-friction-to-iron rubbery polymer (or, for example, fairly soft frictional material such as cork) in sheets, o-rings, cured adherent heavy films of a natural or synthetic rubber, or a vinyl polymer, a hydrocarbon polymer, or the like in place of coating 76.

The force of an end support element being pressed against the collar element of the catch basin grating-holder by a straight and oblique (slanted) turnbuckle corner bolt can be estimated in accordance with the formulae set forth in my U.S. Pat. No. 4,867,600.

Many modifications and variations of the invention will be apparent to those skilled in the art in the light of the foregoing detailed disclosure and drawings. Therefore, it is to be understood that, within the scope of the appended claims, the invention can be practiced otherwise than as shown and described.

I claim:

1. An adjustable insert for raising the grade of a generally rectangular grating that previously was supported in a catch basin frame, the grating originally having been disposed to rest on the end sills of said frame, and further to rest on the roadway-side longitudinal sill of said frame if it has said longitudinal sill, the grating also having been disposed to be at least in part restrained laterally in the frame by collar elements arising from said sills, the insert comprising:

a base, ledge elements supported thereby, which ledge elements form a seat for the grating, and keeper elements attached to and rising above the ledge elements for restricting lateral movement of the grating, the base being adjustable in length and adapted to rest on the sills of the frame, the base comprising a pair of end support elements with terminals and a pair of side support elements with terminals, said end support element terminals being joined with said side support element terminals to form generally a rectangle of the support elements, said rectangle including spreader means that form matched adjustable junctions between each terminal of at least one end support element and a terminal of each side support element for rendering said at least one end support element adjustable-in-length in the plane of the longer axis of the rectangle, the terminals of both side support elements having salient load-bearing portions that extend beyond said adjustable junctions and beyond the inboard edge of the end sills of the frame for obtaining support from said end sills.

2. The insert of claim 1 wherein the base, ledge elements and keeper elements comprise ferrous metal.

3. The insert of claim 2 wherein the base comprises cast iron and the keeper elements comprise sheet steel.

4. The insert of claim 1 wherein the spreader means are screw-operated.

5. The insert of claim 4 wherein the spreader means are turnbuckle bolts.

6. The insert of claim 4 wherein the adjustably-joined terminals are joined by a turnbuckle bolt that has its longitudinal axis normal to the longitudinal axis of the end support element to which it connects and is parallel to the longitudinal axis of the side support element to which it connects.

7. The insert of claim 4 wherein there are four like adjustable junctions, each of which is formed by a turnbuckle bolt whose longitudinal axis is oblique to the longitudinal axes of the side and end support elements to which it connects.

8. The insert of claim 7 wherein the longitudinal axis of each turnbuckle bolt is 45° to the longitudinal axes of the side and end support elements which it connects.

9. The insert of claim 1 wherein the keeper elements have walls of sheet steel, and their upper edges are reenforced by wales, the thickness and depth of each being substantially greater than the thickness of the keeper wall.

10. The insert of claim 9 wherein the wales comprise hollow box members.

11. The insert of claim 9 wherein the wales are solid steel.

12. The insert of claim 9 wherein the outer wall portions of the end support elements are at least partially covered with a frictional retention element.

13. The insert of claim 12 wherein the frictional retention element is a coating adhering to said outer wall portions.

14. The insert of claim 13 wherein the frictional retention element is a cured coating comprising elastomer.

15. The insert of claim 3 wherein the grating is a reticulum grating with rivet heads protruding from its periphery, and the keeper elements have an outward offset below the rivet heads that is sufficient to clear said heads and allow stable lodging of the grating in the insert.

16. In an insert for raising the grade of and retaining a reticulum grating over a catch basin frame, the grating having small protuberances on its periphery, the insert having a base and grating seat and keeper elements supported thereby, the improvement in said insert which comprises:

the keeper elements having an outward offset below said protuberances that is sufficient to clear same and allow stable lodging of the grating in the insert, and the upper edge of each keeper element is reenforced by a wale, the thickness and depth of which is substantially greater than the thickness of the keeper element.

17. The insert of claim 1 wherein the ends of the keeper element on the curb side are foreshortened for fitting into a curb box.

18. The insert of claim 1 wherein the upper corners of the keeper elements are joined by connecting braces.

19. An adjustable insert for raising the grade of a generally rectangular grating that previously was supported in a catch basin frame, the grating originally having been disposed to rest on the end sills of said frame, and further to rest on the roadway-side longitudinal sill of said frame if it has a longitudinal sill, the grating also having been disposed to be at least in part restrained laterally in the frame by collar elements arising from said sills, the insert comprising:

a base, ledge elements forming an essentially flat seat for the grating, and keeper elements extending from and rising above the ledge elements, the base comprising ferrous metal, being adjustable in length, adapted to rest on the sills of the frame, and comprising a pair of end support elements with terminals and a pair of side support elements with terminals, the top of each support element being a ledge element, said terminals being joined to form generally a rectangle, said rectangle including turnbuckle bolts that form matched adjustable junctions between each terminal of at least one end support element and one terminal of each side support element for rendering said at least one end support element adjustable-in-length in the plane of the longer axis of the rectangular insert, the terminals of both side support elements having salient, load-bearing portions that extend beyond said adjustable junctions and beyond the inboard edge of the end sills of the frame for obtaining support from said end sills, the keeper elements comprising sheet steel and restricting lateral movement of the grating, the keeper elements being welded to the support elements of the base and having their upper edges reenforced by a wale, the thickness and depth of which are substantially greater than the thickness of the keeper elements.

20. The insert of claim 18 which is supported almost completely by the end sills of said frame.

21. The insert of claim 19 wherein the longitudinal axis of each turnbuckle bolt is normal to the longitudinal axis of the end support element to which it connects and is parallel to the longitudinal axis of the side support to which it connects.

22. The insert of claim 19 wherein there are four like adjustable junctions and the longitudinal axis of each turnbuckle bolt is 45° to the longitudinal axes of the side and end support elements to which it connects.

23. The insert of claim 19 wherein there is a frictional retention element covering at least part of the outer wall portions the end support elements, and the upper corners of the keeper elements are joined by connecting braces.

24. The insert of claim 19 wherein the ends of the keeper portion on the curb side are foreshortened for fitting into a curb box.

25. The insert of claim 19 wherein the grating is a reticulum grating with protruding rivet heads, and the keeper has an outward offset below the rivet heads that is sufficient to clear same and allow stable lodging of the grating in the insert.

26. The insert of claim 1 wherein the tops of the support elements are the ledge elements that form a seat for the grating.

27. The insert of claim 26 wherein each support element and its keeper element is a unitary structure.

28. The insert of claim 1 wherein each ledge element and its keeper element is unitary structure that is detachable from the support elements of the base.

* * * * *

UNITED STATES PATENT AND TRADEMARK OFFICE

CERTIFICATE OF CORRECTION

PATENT NO. : 5,039,248

DATED : August 13, 1991

INVENTOR(S) : Harold M. Bowman

It is certified that error appears in the above-identified patent and that said Letters Patent is hereby corrected as shown below:

The drawing sheet 3 of 3, should be deleted to be replaced with the drawing sheet 3 of 3, as shown on the attached page.

Signed and Sealed this

Fourteenth Day of December, 1993

*Attest:*

*Attesting Officer*

Bruce Lehman

BRUCE LEHMAN

*Commissioner of Patents and Trademarks*